United States Patent [19]

Mattingly, Jr.

[11] Patent Number: 4,509,814

[45] Date of Patent: Apr. 9, 1985

[54] ELECTRICAL CONNECTOR SHELL ASSEMBLY WITH CONTINUOUS ANNULAR SEAL

[75] Inventor: William R. Mattingly, Jr., Santa Ana, Calif.

[73] Assignee: Matrix Science Corporation, Torrance, Calif.

[21] Appl. No.: 431,483

[22] Filed: Sep. 30, 1982

[51] Int. Cl.[3] ..... H01R 4/00

[52] U.S. Cl. ..... 339/93 R; 339/90 R; 339/94 R

[58] Field of Search ..... 339/94, 89, 90, 93; 285/340, DIG. 18

[56] References Cited

U.S. PATENT DOCUMENTS

| | | | |
|---|---|---|---|
| 2,781,943 | 2/1957 | Carlstrom | 285/DIG. 18 |
| 3,088,089 | 4/1963 | Gregoire | 339/94 R |
| 3,127,182 | 3/1964 | Wardleigh | 285/DIG. 18 |
| 3,463,518 | 8/1969 | Broussard et al. | 285/340 |
| 3,976,352 | 8/1976 | Spinner | 339/94 R |
| 3,985,379 | 10/1976 | Normark | 285/340 |
| 4,373,753 | 2/1983 | Ayers et al. | 285/DIG. 18 |

*Primary Examiner*—Gil Weidenfeld
*Assistant Examiner*—David L. Pirlot
*Attorney, Agent, or Firm*—Nilsson, Robbins, Dalgarn, Berliner, Carson & Wurst

[57] ABSTRACT

An electrical connector with an annular continuous metal to metal seal between the two connector shells includes a cylindrical first shell with an annular radially disposed sealing surface, a cylindrical second shell for being inserted into and clamped to the first shell, a frusto-conical ring attached about a peripheral region of the second shell and having an annular mating edge which is positioned to face the sealing surface of the first shell, and a coupling ring with a bayonet coupling apparatus for clamping the first and second shells into coupling relationship with each other. The positioning of the frusto-conical ring on the second shell is such that when the first and second shells are in the fully mated position, the peripheral mating edge region of the frus-to-conical ring will press against the sealing surface of the first shell to form a continuous annular metal to metal seal between the first shell and the second shell.

11 Claims, 2 Drawing Figures

ELECTRICAL CONNECTOR SHELL ASSEMBLY WITH CONTINUOUS ANNULAR SEAL

BACKGROUND OF THE INVENTION

The present invention relates to electrical connector shell assemblies and in particular to an assembly with a seal between two connector shells.

Connectors for coupling electrical cables consisting of a plurality of individual leads are well known. Such connectors are generally used in electronic systems to electrically couple the various components together. In many systems such as aircraft systems, military vehicle systems and the like, the connectors must operate without failing in severe climatic, vibrational or electrical interference environments. Despite the large number of connector designs, present day connectors are still subject to failures due to these factors. Such failures can result in the failure of an entire system.

To solve such failure problems, various maintenance programs have been initiated to prevent the failures before they happen. However, it is still an objective to obtain a connector which will have substantially greater immunity to failure due to vibration or climatic conditions and will provide a greater degree of shielding against electromagnetic interference.

Therefore, in accordance with the present invention, a connector shell assembly is provided which incorporates an annular frusto-conical ring which is mounted to one of two connector shells with a facing radially disposed seal surface on the opposite connector shell so that when the two connector shells are brought into coupling relationship with each other, the outermost edge of the frusto-conical ring meets and presses against the sealing surface to be resiliently deformed axially to form a metal-to-metal annular continuous seal between the two connector shells. This seal has been found to prevent contaminates from entering the central junction region between leads on the inside of the connector. For example, when fully mated, the continuous, annular metal-to-metal seal between the two shells prevents the passage of moisture into the junction between the two shells thereby significantly decreasing the possibility of electrical shorting between leads.

In addition, the annular continuous seal creates metal to metal bottoming about the entire circumference of the shell junction enabling the connector to successfully withstand significantly higher vibrational conditions than was possible before.

Finally, the present connector, when fully mated, has been found to effectively shield the electrical leads from high levels of electromagnetic interference.

Therefore, the present invention provides a significantly improved connector shell assembly which greatly reduces connector failures due to vibration, electromagnetic interference and extreme climatic conditions.

SUMMARY OF THE INVENTION

An electrical connector in accordance with the invention includes a cylindrical first shell having an annular, radially disposed sealing surface, a cylindrical second shell for being coupled to the first shell, a frusto-conical ring coupled to the second shell, and means for clamping and holding the first and second shells together in mating relationship. In accordance with the invention, the frusto-conical ring has an inner edge region which is attached by suitable means to a peripheral region of the second shell and an annular mating edge which is remote from the inner edge region and which is axially and radially spaced from the inner edge region. The mating edge region has a radius selected for circumferentially contacting the annular sealing surface of the first shell when the first and second shells are coupled together. Thus, when the first and second shells are in mating relationship, the mating edge of the frusto-conical ring presses against the sealing surface of the first shell and thereby forms a continuous metal to metal annular seal between the first shell and the second shell.

In accordance with the invention, the frusto-conical ring is resiliently axially deformable to form a tight seal between the first and second shell members along the junction between the mating edge of the frusto-conical ring and the sealing surface of the first shell.

The connector assembly may include a coupling ring having an interior pressing shoulding and an inner cylindrical surface with a plurality of bayonet grooves disposed therein. The coupling ring further includes a plurality of radial orifices each defining the terminus of one of the bayonet grooves. A circumferential clamping shoulder is disposed to extend radially outwardly relative to the outer surface of the second shell. A plurality of bayonet pins are attached to extend radially out from the outer surface of the first shell. Each such bayonet pin is positioned for engaging one of the bayonet grooves as the coupling ring is rotated relative to the first shell and seating in one of the orifices when the first and second shells are pressed into full engagement. In such full engagement, the pressing shoulder is positioned to press against a radially disposed shoulder of the second shell to press the annular mating edge of the frusto-conical ring into compression contact against the annular sealing surface.

The frusto-conical ring may be attached about the periphery of the second shell by any suitable means. For example, a suitable ring mounting flange may be provided about the periphery of the second shell where the ring mounting flange defines an annular mounting surface from which an angled contact surface extends axially and radially. The innermost radius of the frusto-conical ring is selected so that the ring fits over and around the annular mounting surface with the inner edge region of the frusto-conical ring positioned against the angled contact surface. An annular clamping ring is provided for being pressed over the annular mounting surface into clamping contact against the inner edge region of the frusto-conical ring for holding the frusto-conical ring in position with the inner edge region pressed against the angled contact surface.

BRIEF DESCRIPTION OF THE DRAWINGS

A complete understanding of the present invention and of the above and other advantages may be gained from a consideration of the following description of the preferred embodiment taken in conjunction with the accompanying drawings in which.

DETAILED DESCRIPTION

Figure 1:
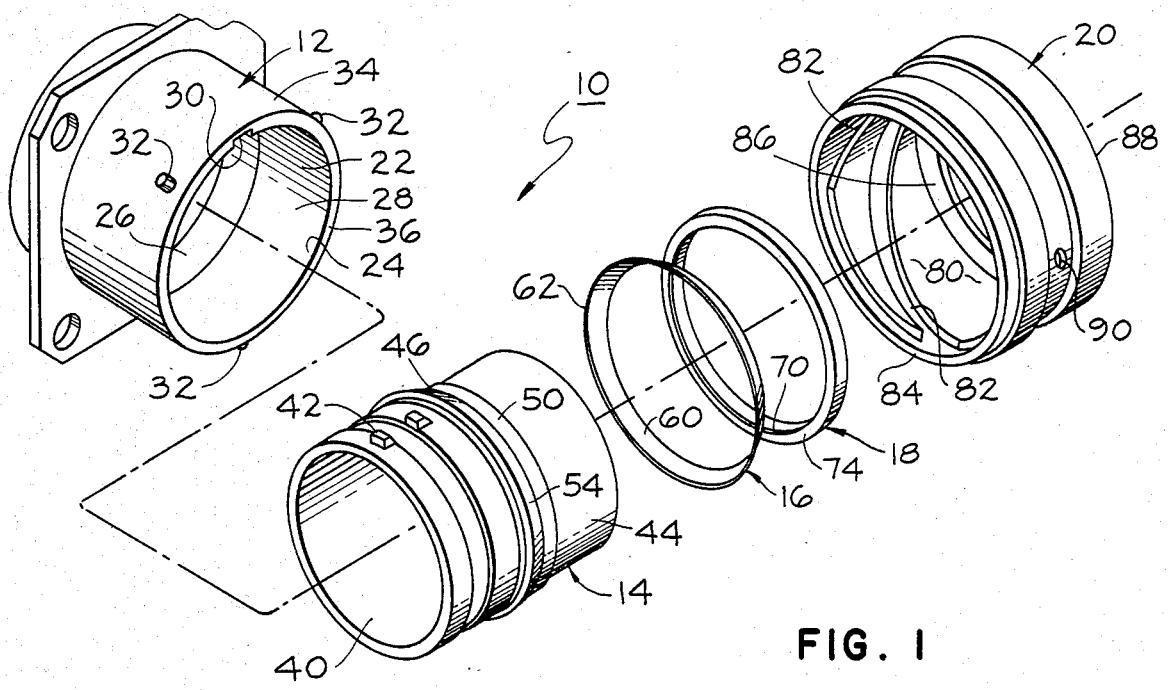
FIG. 1 is an exploded perspective view of a connector shell assembly in accordance with the invention.

Referring initially to FIG. 1, an electrical connector shell assembly 10 includes a first cylindrical shell 12, a second cylindrical shell 14, a frusto-conical ring 16 mounted on the outside of the second shell 14, a clamping ring 18 for being mounted on the second shell 14 to hold the frusto-conical ring 16 in place and a coupling ring 20 for selectively clamping the first shell 12 and the second shell 14 together. In use, the first shell 12 will have an insert member with a plurality of electrical contacts and the second shell 14 will similarly have an insert member with a plurality of mating electrical contacts. For simplicity, the insert members are not shown.

The first shell 12 is generally cylindrical and defines a central cylindrical space 22 defined by the inside surface 24 of the first shell 12. In the case where the first shell 12 is adapted to hold an insert with protruding pins (not shown) the cylindrical space 22 will preferably be divided into a first region 26 in which the pin insert member is mounted and held, and a second region 28 into which the individual pins extend.

When the second cylindrical shell 14 is coupled to the first cylindrical shell 12, one end of the second cylindrical shell 14 is inserted into the second region 28. As the end of the second cylindrical shell 14 is inserted into the cylindrical space 22, the pins protruding into the second region 28 engage individual sockets in a socket insert member (not shown) held in a cylindrical space 40 in the second shell 14.

The proper orientation of the second shell 14 with the first shell 12 is assured by aligning a protrusion or key 42 extending from one location about the circumference of one end of the second shell 14 with a keyway 30 which is axially disposed in one region of the inside surface 24 of the first shell 12.

The first shell 12 also includes three bayonets 32 which are attached to extend radially from the outside surface 34 of the first shell 12. The bayonets 32 comprise one element of the means used to enable the coupling ring 20 to pull the first shell 12 and the second shell 14 together into clamping relationship to each other.

Finally, the first shell 12 has an annular sealing surface 36 which in the illustrated embodiment is the cylindrical end surface of the first shell 12 adjacent the second region 28 and defines one terminus of the inside surface 24.

Figure 2:
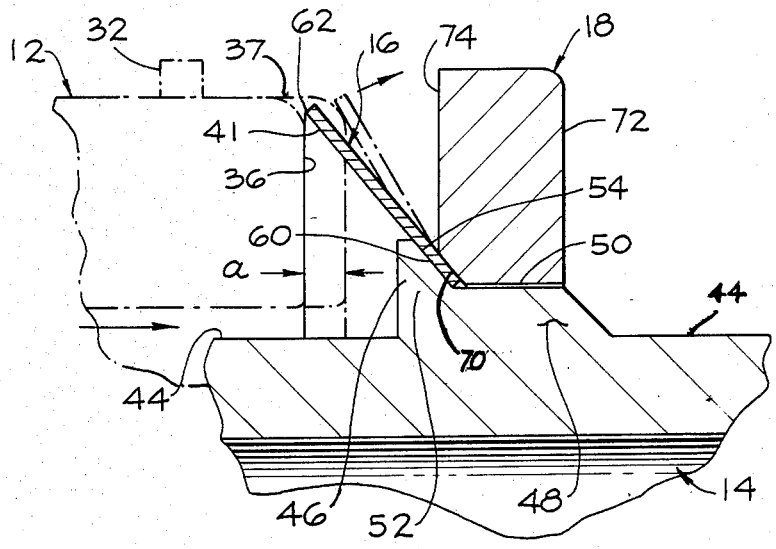
FIG. 2 is a side cross-sectional view showing the coupling between the first and second shell to illustrate the metal-to-metal seal provided by the frusto-conical ring in accordance with the invention.

Referring to FIG. 1 in conjunction with FIG. 2, the second shell 14 is also cylindrical having an outside surface 44 from which an annular ring mounting flange 46 protrudes. In the preferred embodiment, the ring mounting flange 46 is an integral part of the second shell 14. However, it may be attached to extend from the outside surface 44 in any suitable manner.

The ring mounting flange 46 has a first flange region 48 with an annular mounting surface 50 which is substantially parallel to the outside surface 44 of the second shell 14 but of a somewhat larger diameter, and a second flange region 52 which extends radially outwardly from the mounting surface 50 between one edge of the mounting surface 50 and a central region of the outside surface 44. The second flange region 42 has an angled contact surface 54 which extends from the annular mounting surface 50 in a direction both axially and radially away from the annular mounting surface 50.

The frusto-conical ring 14 includes an inner edge region 60, and an annular mating edge 62 opposite the inner edge 60. The mating edge is positioned and sized to be pressed against the sealing surface 36 of the first shell 12 when the second shell 14 is inserted into the second region 28. In accordance with the invention, the frusto-conical ring is resiliently deformable in an axial direction relative to the annular mounting surface 50 as illustrated in FIG. 2.

In accordance with the illustrated embodiment, the frusto-conical ring 16 is held in place by the clamping ring 18 which has an inside diameter selected so that the clamping ring can be over the annular mounting surface 50. In the preferred embodiment, the innermost corner region of the clamping ring 18 is angled to define an angled clamping surface which presses against the inner edge region 60 of the frusto-conical ring 16 as illustrated in FIG. 2. The frusto-conical ring 16 can therefore be clamped and held between the angled clamping surface 70 of the clamping ring 18 and the angled contact surface 54 of the second flange region 52 of the ring mounting flange 46. The inner edge region 60 of the frusto-conical ring 16 is therefore the holding or clamping point about which the frusto-conical ring 16 is resiliently deformed when the mating edge 62 is pressed against the sealing surface 36.

The clamping ring 18 also defines a clamping shoulder 72 which is the back surface of the clamping ring 18 opposite the ring facing a surface 74.

In accordance with one embodiment of the invention, the first and second shells 12 and 14 may be clamped together utilizing the coupling ring 20 which consists of a cylindrical member having an interior surface 80 with a plurality of inwardly spiraling bayonet grooves 82 positioned to be compatible with and receive the bayonets 32 extending from the first shell 12. The bayonet grooves 82 spiral inwardly in the inner surface 80 from a first end 84 which is positioned to face the first shell 12 when engaging the first and second shells 12 and 14. An annular pressing shoulder 86 is disposed to extend radially inwardly adjacent the second end 88 of the coupling ring 20.

In operation, the second shell 14 with the frusto-conical ring 16 and the clamping ring 18 permanently mounted to the ring mounting flange 46 of the second shell, is inserted into the cylindrical space 22 of the first shell 12 with the key 42 inserted into the keyway 30 to radially allign the second shell 14 with the first shell 12. When so engaged, the mating edge 62 of the frusto-conical ring 16 faces and is adjacent to the sealing surface 36 of the first shell 12. The frusto-conical ring 16 thus maintains the sealing surface 36 at a spaced distance from the ring mounting flange 46. In the illustrated embodiment, the mating edge contacts a curved peripheral region 37 of the sealing surface 36 which has a surface which is more parallel to the surface 41 of the frusto-conical ring so that the width of the region of metal-to-metal contact between the sealing surface and the frusto-conical ring is increased. Of course, other configurations of the part of the sealing surface which comes into contact with the frusto-conical ring to form the seal are also possible in accordance with the invention.

In order to clamp the first shell 12 and the second shell 14 into mating relationship, the coupling ring 20 is inserted over the end of the second shell 14 opposite the end which is inserted into the cylindrical space 22 of the first shell 12, and is rotated until the bayonets 32 engage the bayonet grooves 82. As the coupling ring 20 is further rotated, the bayonets 32 move along the spiral bayonet grooves 82 until the pressing shoulder 86 comes in contact with the clamping shoulder 72. Thereafter, further twisting of the coupling ring 20 forces the clamping shoulder 72 to move toward the bayonet 32 thereby forcing the mating edge 62 against the mating region 37 of the sealing surface 36 about the entire periphery of the sealing surface 36 until the bayonets 32 engaged suitably positioned orifices 90 in the coupling ring at the terminus of each of the bayonet grooves 82.

When so mated, the mating edge 62 of the frusto-conical ring 16 will have been deflected axially by a distance "a" to form a continuous annular metal-to-metal bottoming seal which is capable of withstanding substantially higher vibrational conditions than has heretofore been realized. In one example, the amount of axial deflection was in the range of 0.005 to 0.02 inches for a metal frusto-conical ring about $1\frac{3}{8}$ inches in diameter. Additionally, the resultant metal-to-metal seal between the mating edge 62 of frusto-conical seal 16 and the sealing surface 36 prevents moisture from passing from the outside of the connector assembly to the interior of the connector assembly and into the insulator insert interface. Finally, the resultant metal-to-metal seal effectively shields high levels of electrical interference from corrupting signals on the leads being coupled together by the connector assembly 10.

It will, of course, be appreciated that numerous variations are possible and that the above-described illustrated embodiment represents only one specific embodiment of the invention. For example, the frusto-conical ring 16 may be attached about the central peripheral region of the second shell 14 in any suitable manner such as, for example, welding or insertion into an integrally formed grove in the surface of the second shell 14. In addition, while a bayonet system of clamping has been disclosed, it will be appreciated that a suitable seal can be formed between a sealing surface and a mating edge of a frusto-conical ring utilizing any other suitable clamping mechanism.

The above embodiment also illustrates the frusto-conical ring 16 as being mounted on the second shell 14 about a central peripheral position. However, the frusto-conical ring could be mounted to the sealing surface 36 to extend outwardly therefrom to press against, for example, the ring facing surface 74 of the clamping ring 18. In such a circumstance, the seal would be formed between the mating edge 62 of the frusto-conical ring 16 and the ring facing surface 74 which would then become the sealing surface for the connector. Finally, a suitable wave spring (not shown) could be incorporated between the annular pressing shoulder 86 and the clamping shoulder 72 to provide auxiliary resiliency between the first shell and the coupling ring.

Various other modifications and alterations in accordance the invention will be appreciated by those skilled in the art. It is therefore the object of the appended claims to cover all modifications and alterations which fall within the true spirit and scope of the invention.

What is claimed is:

1. An electrical connector comprising:

a cylindrical first shell having a metal sealing surface with an annular, planar radially disposed end face and an annular, convex corner portion about the outermost terminus of the planar radially disposed end face;

a cylindrical second shell for being coupled with the first shell;

a frusto-conical metal ring having an annular inner edge region immoveably attached about the periphery of the second shell and axially spaced from the sealing surface, and having an annular mating edge region remote from the inner edge region, the mating edge region extending toward the sealing surface and being axially and radially spaced from the inner edge region, the mating edge region circumferentially contacting and the abutting sealing surface when the first and second shells are coupled together in full engagement effectuating resilient axial deflection of the annular mating edge region relative to the annular inner edge region whereby the metal ring is resiliently bent along its length between the inner edge region and the mating edge region, the mating edge region being moveable along the sealing surface;

means for clamping and holding the first and second shell members in mating relationship with the mating edge region of the frusto-conical metal ring pressed in axial deflection relationship against the metal sealing surface of the first shell for forming a continuous annular metal-to-metal seal between the metal sealing surface of the first shell and the annular mating edge region of the metal ring.

2. The electrical connector of claim 1 wherein the means for clamping and holding comprises a bayonet coupling, comprising:

a coupling ring having an interior pressing shoulder and an inner cylindrical surface with a plurality of bayonet grooves disposed therein; a plurality of orifices, each defining the terminus of one of the bayonet grooves; and a circumferential clamping shoulder disposed to extend radially relative to the outer surface of the second shell; and a plurality of bayonet pins attached to extend radially out from the outer surface of the first shell, each being positioned for engaging in one of the bayonet grooves as the coupling ring is rotated relative to the first shell and seating in one of the orifices when the first and second shells are pressed into full engagement, the pressing shoulder axially positioned to press against the clamping shoulder to thereby press and maintain the annular mating edge of the metal ring in pressing, stiff, spring-like, abutting contact against the annular sealing surface when the coupling ring is in full engagement with the first shell.

3. The electrical connector of claim 1 wherein the second shell has an annular ring mounting flange defining an annular mounting surface and an angled contact surface extending axially and radially from the mounting surface whereby the inner edge region of the frusto-conical metal ring is positioned against the angled contact surface, the electrical connector further comprising:

an annular clamping ring for being pressed over the annular mounting surface into clamping contact against the inner edge region of the frusto-conical metal ring for immoveably holding the frusto-conical metal ring in position with the inner edge region pressed against the angled contact surface whereby the metal ring bends annularly at a location adjacent the inner edge region in response to the annular deflection of the mating edge region upon contact with the metal sealing surface.

4. The electrical connector of claim 3 wherein the annular clamping ring has an angled clamping surface adjacent the inner edge region of the frusto-conical metal ring whereby the inner edge region of the frusto-conical metal ring is clamped between the angled clamping surface of annular clamping ring and the angled contact surface of the ring mounting flange of the second shell.

5. The electrical connector of claim 2 wherein the second shell has an annular ring mounting flange defining an annular mounting surface and an angled contact surface extending axially and radially from the mounting surface whereby the inner edge region of the frusto-conical metal ring is positioned against the angled contact surface, the electrical connector further comprising:

an annular clamping ring for being pressed over the annular mounting surface into clamping contact against the inner edge region of the frusto-conical metal ring for holding the frusto-conical metal ring in position with the inner edge region pressed against the angled contact surface whereby the metal ring bends annularly at a location adjacent the inner edge region in response to deflection of the mating edge region by contact with the metal sealing surface.

6. The electrical connector of claim 5 wherein the annular clamping ring has an angled clamping surface adjacent the inner edge region of the frusto-conical metal ring whereby the inner edge region of the frusto-conical metal ring is clamped between the angled clamping surface of the annular clamping ring and the angled contact surface of the ring mounting flange of the second shell.

7. An electrical connector comprising:

a cylindrical first shell having a metal sealing surface with an annular, planar radially disposed end face and an annular convex corner portion about the outermost terminus of the planar radially disposed end face, the first shell defining a central cylindrical receiving region therein;

a cylindrical second shell for being selectively inserted into the central receiving region of the first shell;

a frusto-conical metal ring having an inner edge region immoveably attached to the outer surface of the second shell about its circumference and further having an annular mating edge region remote from the inner edge region for contacting abutting and pressing against the sealing surface when the second shell is in mating relationship to the first shell and for effecting axial deflection of the annular mating edge region relative to the annular inner edge region about the circumference of the metal ring whereby the metal ring is resiliently bent along its dimension between the inner edge region and the mating edge region with the mating edge region being moveable along the sealing surface;

means for clamping and holding the first shell and the second shell in full mating relationship whereby the mating edge of the frusto-conical metal ring resiliently axially deflects relative to the inner edge in response to compression of the mating edge region against the annular sealing surface to form a continuous annular metal-to-metal seal between the metal sealing surface of the second shell and the annular mating edge region of the metal ring.

8. The electrical connector of claim 7 wherein the means for clamping and holding comprises a bayonet coupling, comprising:

a coupling ring having an interior pressing shoulder and an inner cylindrical surface with a plurality of bayonet grooves disposed therein; a plurality of orifices each defining the terminus of one of the bayonet grooves; and a circumferential clamping shoulder disposed to extend radially relative to the outer surface of the second shell; and a plurality of bayonet pins attached to extend radially out from the outer surface of the first shell, each being positioned for engaging in one of the bayonet grooves as the coupling ring is rotated relative to the first shell and seating in one of the orifices when the first and second shells are pressed into full engagement, the pressing shoulder axially positioned to press against the clamping shoulder to thereby press and maintain the annular mating edge of the metal ring in pressing, stiff, spring-like, abutting contact against the annular sealing surface when the coupling ring is in full engagement with the first shell.

9. The electrical connector of claims 7 or 8 wherein the annular clamping ring has an angled clamping surface adjacent the inner edge region of the frusto-conical metal ring whereby the inner edge region of the frusto-conical metal ring is clamped between the angled clamping surface of annular clamping ring and the angled contact surface of the ring mounting flange of the second shell.

10. The electrical connector of claims 7 or 8 wherein the second shell has an annular ring mounting flange defining the an annular mounting surface and an angled contact surface extending axially and radially from the mounting surface whereby the inner edge region of the frusto-conical metal ring is positioned against the angled contact surface, the electrical connector further comprising;

an annular clamping ring for being pressed over the annular mounting surface into clamping contact against one side of the inner edge region of the frusto-conical metal ring for immoveably holding the frusto-conical metal ring in position with the other side of the inner edge region pressed against the angled contact surface whereby the metal ring bends annularly at a location adjacent the inner edge region in response to deflection of the mating edge region by contact with the metal sealing surface.

11. The electrical connector of claim 10 wherein the annular clamping ring has an angled clamping surface for being positioned adjacent the inner edge region of the frusto-conical metal ring whereby the inner edge region of the frusto-conical metal ring is clamped between the angled clamping surface of the annular clamping ring and the angled contact surface of the ring mounting flange of the second shell.

* * * * *